United States Patent [19]

Seeley

[11] 4,451,084

[45] May 29, 1984

[54] BACKREST HEIGHT ADJUSTMENT FOR OFFICE CHAIR

[75] Inventor: Wayne C. Seeley, York, Pa.

[73] Assignee: Simmons Universal Corporation, New York, N.Y.

[21] Appl. No.: 330,280

[22] Filed: Dec. 14, 1981

[51] Int. Cl.[3] ..... A47C 7/46

[52] U.S. Cl. ..... 297/353; 297/410; 403/105; 248/297.3

[58] Field of Search ..... 297/353, 356, 410; 248/297.3; 108/146; 403/105, 330

[56] References Cited

U.S. PATENT DOCUMENTS

| | | | |
|---|---|---|---|
| 1,204,858 | 11/1916 | Gest | 248/297.3 X |
| 1,679,168 | 7/1928 | O'Brien . | |
| 2,096,452 | 10/1937 | Eber | 403/105 X |
| 2,221,123 | 11/1940 | Wiley . | |
| 2,229,513 | 1/1941 | Lustig . | |
| 2,264,382 | 12/1941 | Keller . | |
| 2,378,852 | 6/1945 | James . | |
| 2,392,477 | 1/1946 | Holm . | |
| 2,405,013 | 7/1946 | Campbell . | |
| 2,581,235 | 1/1952 | Broberg | 74/531 |
| 2,643,922 | 6/1953 | Rudman . | |
| 2,975,994 | 3/1961 | Goss | 248/478 X |
| 3,285,207 | 11/1966 | Cohen . | |
| 3,526,430 | 9/1970 | Eldon | 297/353 |
| 3,563,603 | 2/1971 | D'Aprile | 297/410 |
| 3,854,428 | 12/1974 | Fullenkamp . | |
| 3,860,286 | 1/1975 | Rasmussen | 297/410 X |
| 3,952,987 | 4/1976 | Bevington . | |
| 4,221,430 | 9/1980 | Frobose | 297/353 |
| 4,384,742 | 5/1983 | Wisniewski | 297/353 |

FOREIGN PATENT DOCUMENTS

| | | | |
|---|---|---|---|
| 1371641 | 10/1974 | United Kingdom | 297/353 |

*Primary Examiner*—William E. Lyddane
*Assistant Examiner*—Peter R. Brown
*Attorney, Agent, or Firm*—Bell, Seltzer, Park & Gibson

[57] ABSTRACT

A housing is fixed on the backrest and supports the same for vertical sliding movement on the upper end portion of a vertical support member. Notches are spaced vertically along the upper portion of the support member and a pawl is pivotally supported on the housing and includes a ratchet finger movable between an operative position with the ratchet finger in engagement with the notches and an inoperative position with the ratchet finger out of engagement with the notches. A spring is associated with the pawl and is operable to selectively maintain the pawl and ratchet finger in either the operative or inoperative positions. When the backrest is raised to the uppermost adjusted position, the pawl; is switched to the inoperative position and the backrest may be freely lowered to the lower end of the adjustment limit in preparation for a subsequent adjustment in the upward direction.

11 Claims, 8 Drawing Figures

BACKREST HEIGHT ADJUSTMENT FOR OFFICE CHAIR

Field of the Invention

This invention relates generally to a backrest height adjustment for office chairs, and more particularly to such an adjustment which permits the height of the backrest to be easily adjusted while the user is seated in the normal position in the chair.

Background of the Invention

Many different types of backrest height adjustments have been proposed for use with posture chairs. Most of these height adjustment mechanisms require that the user manipulate either a hand wheel, a pushbutton, or a lever to vertically adjust the position of the backrest, relative to the seat. These adjustment mechanisms usually require the user to turn the body in the seat to an uncomfortable position in order to operate the adjusting mechanism. When in this position, it is difficult for the user to determine the best position for the backrest when normally seated in the seat. In some instances, it is necessary that the user adjust the mechanism from a standing position at the rear of the chair and it is difficult to determine the proper adjustment of the position of the backrest when not seated in the chair.

U.S. Pat. No. 3,854,772 discloses a backrest height adjustment employing a cam lock device which may be operated by an operating handle or lever by the user when seated in the chair. However, the user must place one hand in the center of the backrest to operate the operating handle and this type of movement is difficult for some people. Also, the operating handle or lever may work itself out of the locking position or may be accidentally engaged to release the backrest so that the proper height adjustment is not maintained.

In each of the prior art types of backrest adjustment devices, some type of external knob, button, handwheel, lever, etc. is provided. These external control devices are unsightly and are subject to being caught on the clothing of the users or the external control may engage and damage other office furniture, such as the desk or the like.

Summary of the Invention

With the foregoing in mind, it is an object of the present invention to provide a backrest height adjustment for office chairs which may be easily adjusted by the user while in the normal seated position and which eliminates the need for external wheels, knobs, buttons, levers and the like. The backrest height adjustment is maintained in the adjusted position in a positive manner and is easy to adjust while in the normal seated position so that the user will tend to use the adjustment more often to improve comfort, reduce fatigue and increase productivity.

The backrest height adjustment of the present invention incorporates a cyclic motion and upward vertical adjustment of the backrest may be accomplished by merely raising the backrest to the desired level and the backrest will remain in this adjusted position. When the uppermost position of the backrest is reached, the adjustment device is disengaged so that the backrest may be freely lowered to its lowermost position. In the lowermost position, the backrest height adjustment is again activated and the backrest may be raised to any desired positive adjusted position. Thus, the height of the backrest can be adjusted by merely lowering and then raising the backrest and this adjustment can be easily carried out while the user is in the normal seated position.

The backrest height adjustment includes a housing fixed on the backrest and supporting the same for vertical sliding movement on the upper portion of a vertical support member, the lower end of which is attached to the seat. Notches are spaced vertically along the upper portion of the support member and a pawl is pivotally supported on the housing and includes a ratchet finger movable between an operative position with the ratchet finger in engagement with the notches and an inoperative position with the ratchet finger out of engagement with the notches. An over center spring is associated with the pawl and is operable to selectively maintain the pawl and ratchet finger in either the operative or inoperative positions. When the pawl is raised to the upper end of the notches, it is moved to and resiliently maintained in the inoperative position so that the backrest may be freely lowered vertically to the lower end of its adjustment limit. A cam member is provided at the lower end of the notches for engagement with the pawl to move the same into the operative position when the backrest is in the lowermost position so that the ratchet finger resiliently engages the notches as the backrest is raised and may be maintained in any of the vertically spaced notches as it is moved upwardly.

BRIEF DESCRIPTION OF THE DRAWINGS

Other objects and advantages will appear as the description proceeds when taken in connection with the accompanying drawings, in which:

FIG. 3 is a vertical sectional view taken substantially along the line 3—3 in FIG. 2 and with a portion of the housing broken away;

DESCRIPTION OF THE ILLUSTRATED EMBODIMENT

Figure 1:
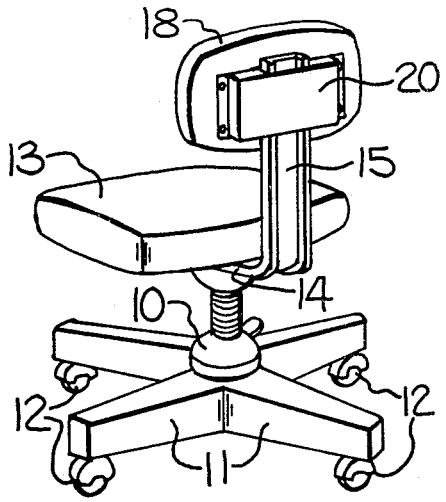
FIG. 1 is a perspective view of the rear of an office chair with the backrest height adjustment of the present invention applied thereto.

The backrest height adjustment of the present invention is illustrated in FIG. 1 as being applied to a posture chair of the secretarial type. However, it is to be understood that the present invention may also be used in connection with executive or other types of posture chairs which may include arms attached to the seat and/or to the back. The chair includes the usual pedestal 10 having outwardly radiating legs 11 with rollers or coasters 12. The pedestal 10 may be vertically adjustable and a seat 13 is supported on the upper end thereof. The lower horizontal end portion 14 of a vertical backrest support member 15 is supported on the seat 13 in the usual manner and may be supported for inward and outward adjustment.

A backrest 18 is supported for vertical adjustment, by means of the height adjustment device of the present invention, on the upper end portion of the support member 15 and a shroud or cover 20 is fixed on the rear of the backrest 18 and completely covers the backrest height adjustment of the present invention.

Figure 2:
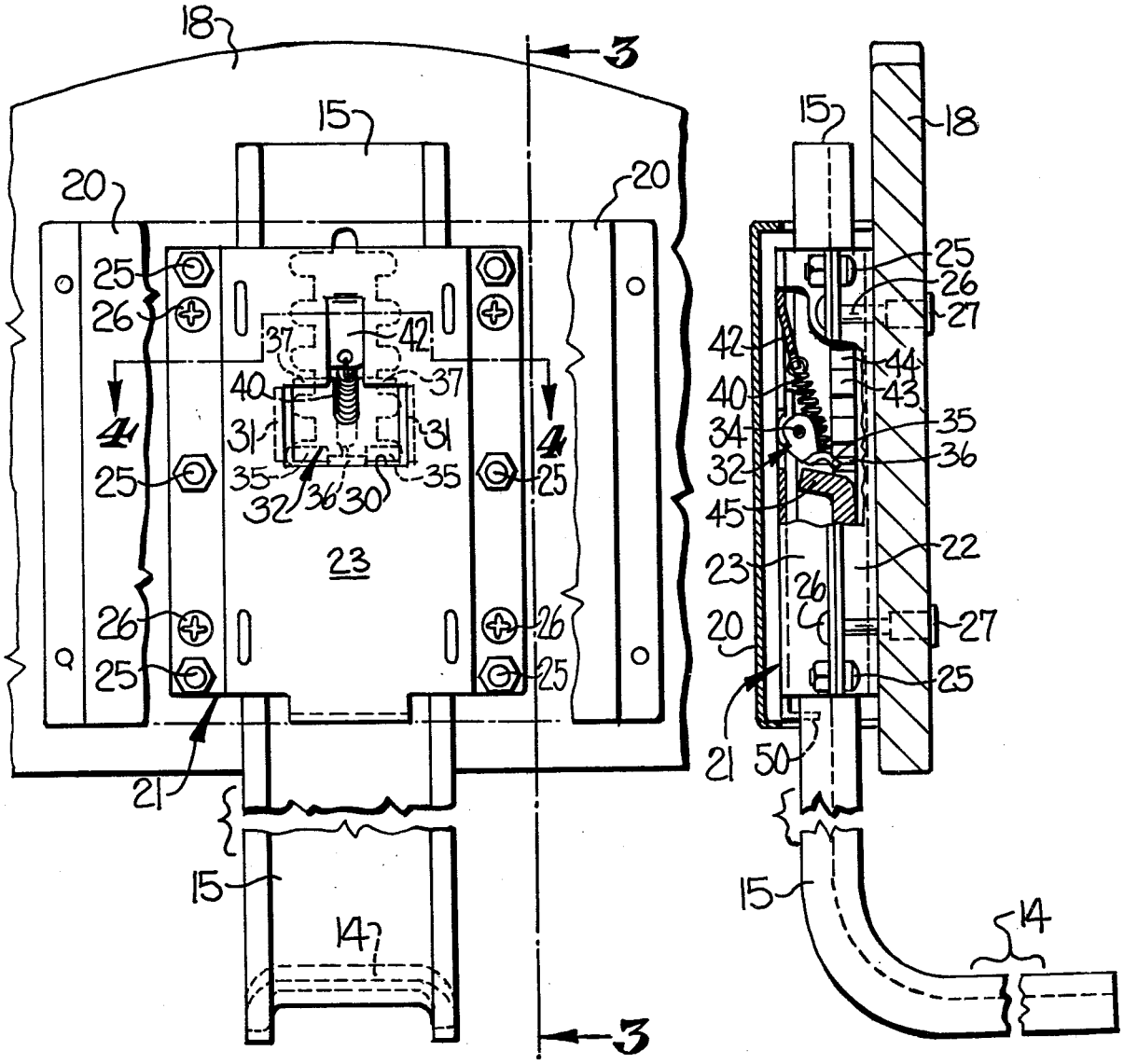
FIG. 2 is a fragmentary elevational view of a portion of the rear of the backrest and showing the shroud being broken away to illustrate the present invention.

The present backrest adjusting means includes a housing, broadly indicated at 21, which includes stamped front and rear housing plates 22, 23. Opposite side portions of the housing plates 22, 23 are bent to form mating connector flanges (FIG. 4) which are secured together by suitable nuts and screws 25. The housing 21 is fixed on the backrest 18 by screws 26 (FIGS. 2 and 3) which extend into and their inner ends are threadably supported in Teenuts 27. The front plate 23 (FIG. 2) is provided with an inverted T-shaped cutout 30 and opposite sides of the cutout 30 are bent inwardly to form a pair of pivot plates 31.

Figure 5:
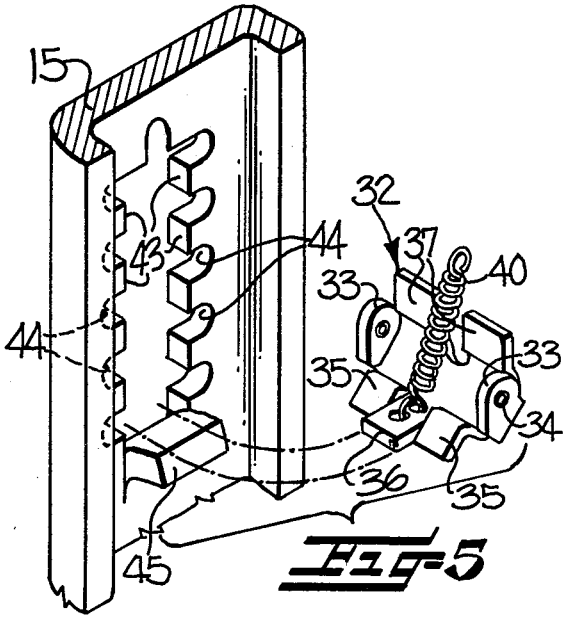
FIG. 5 is a fragmentary isometric view of a portion of the backrest support, showing the vertically extending notches along the upper portion thereof, and the pivotally supported pawl which cooperates therewith.

A pawl, broadly indicated at 32, is provided with a pair of side pivot plates 33 (FIG. 5) which are positioned inside of the pivot plates 31 of the housing 21 and are pivotally connected thereto, as indicated at 34 in FIG. 3, so that the pawl 32 is pivotally connected to the housing 21. The lower end portion of the pivot pawl 32 is provided with a pair of downwardly angled ratchet fingers 35 and an operating tongue 36 extending outwardly between the ratchet fingers 35. The upper end of the pivot pawl 32 is provided with a pair of upstanding stop legs 37.

Over center spring means, in the form of a tension spring 40, is connected at its lower end to holes provided in the tongue 36 of the pawl 32. The upper end of the spring 40 is suitably connected to the lower end of an inwardly bent portion of the front plate 23, forming a spring perch 42, which may be bent inwardly and outwardly to adjust the position of the upper end of the spring 40.

The upper end portion of the support member 15 is provided with notch means extending vertically therealong and is illustrated as including a slot 43 (FIG. 5) with spaced notches 44 extending along opposite sides thereof. The tongue 36 of the pawl 42 is adapted to ride in the slot 43 and the ratchet fingers 35 are adapted to engage the notches 44 when the backrest 18 is moved upwardly and the pawl 32 is in the operative position. The lower end of the notch means is provided with an inwardly curved cam member 45 (FIGS. 5–8) which forms a part of the pivot pawl operator means, to be presently described.

Figure 4:
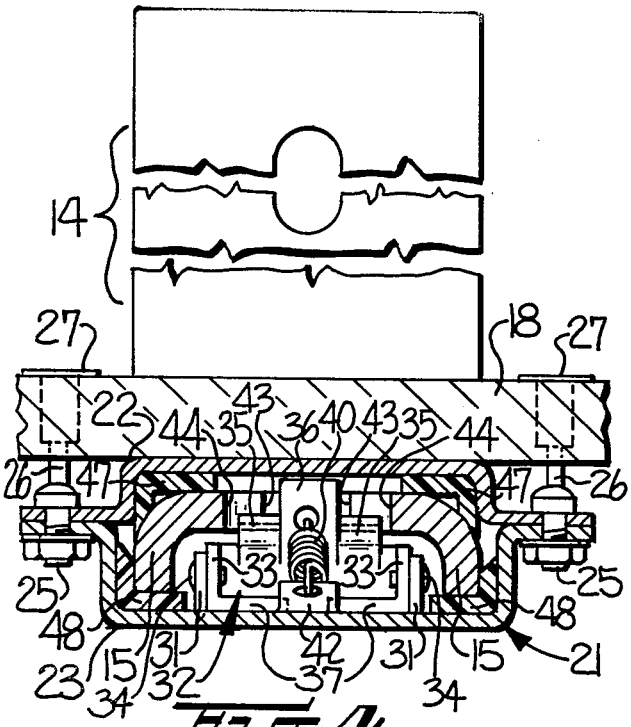
FIG. 4 is a horizontal sectional view taken substantially along the line 4—4 in FIG. 2.

As will be noted in FIG. 4, the support member 15 is provided with forwardly bent flanges at each side thereof to lend rigidity thereto and rear slide guide bars 47 are supported in the rear plate 22 and slidably engage the rear portion of the support member 15. Slide guide bars 48 are supported in the front plate 23 and engage the front edges and sides of the support member 15. The guide bars 47, 48 are formed of suitable plastic material so that the housing 21 is supported for free vertical sliding movement on the support member 15.

Operator means is associated with the upper and lower ends of the notch means and is adapted to be engaged by the pawl 32 and to switch the same between the operative and inoperative positions. When the housing 21 and the backrest 18 are raised from the lowermost position shown in FIGS. 3 and 6, the ratchet fingers 35 are resiliently cammed up the notches 44 by the tension spring 40 because the longitudinal axis of the spring 40 provides a line of action which is forward of the pivot point 34 of the pawl 32. When the backrest 18 is raised, as shown in FIG. 7, the ratchet fingers 35 will resiliently engage the notches 44 and the pawl 32 will move in a counterclockwise direction when the desired level is reached so that the lower ends of the ratchet fingers 35 will engage the bottom of the notch 44 and the stop legs 37 will engage the inner surface of the front plate 23, as shown in FIG. 6, and maintain the backrest 18 in the adjusted position.

If it is desired to lower the position of the backrest 18 from a previously adjusted position, the backrest 18 and the housing 21 are raised to the uppermost position where an inwardly bent stop 50 (FIG. 8) engages cam member 45. As the housing 21 reaches this uppermost position, the tongue 36 of the pawl 32 engages the upper end of the slot 43 and the pawl 32 is moved a sufficient distance in a clockwise direction so that the longitudinal axis and the line of action of the spring 40 will be positioned rearwardly of the pivot point 34 of the pawl 32. The spring 40 will then switch the pawl 32 to the inoperative position shown in FIG. 8 and the backrest 18 and the housing 21 can then be lowered down the support member 15.

Figure 6:
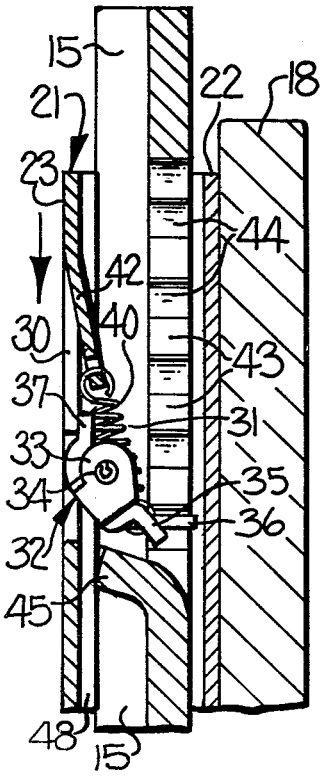
FIG. 6 is an enlarged vertical sectional view of the height adjustment mechanism in its lowermost adjusted position.
Figure 7:
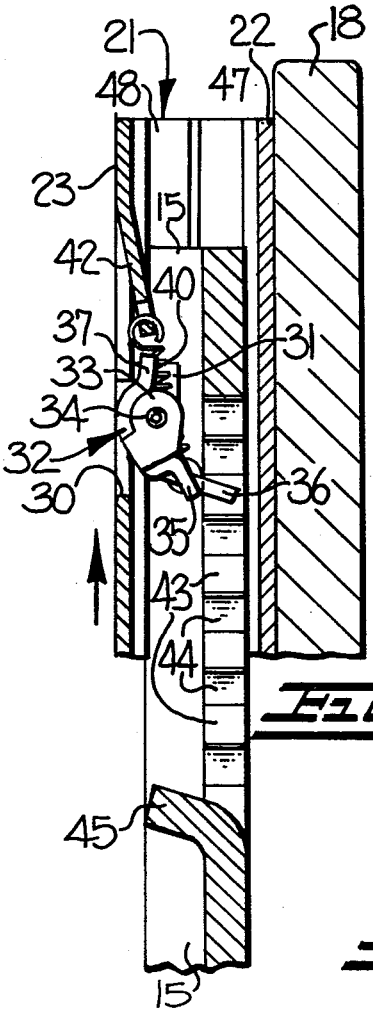
FIGS. 7 and 8 are similar to FIG. 6 but show the backrest in respective intermediate and uppermost positions.
Figure 8:
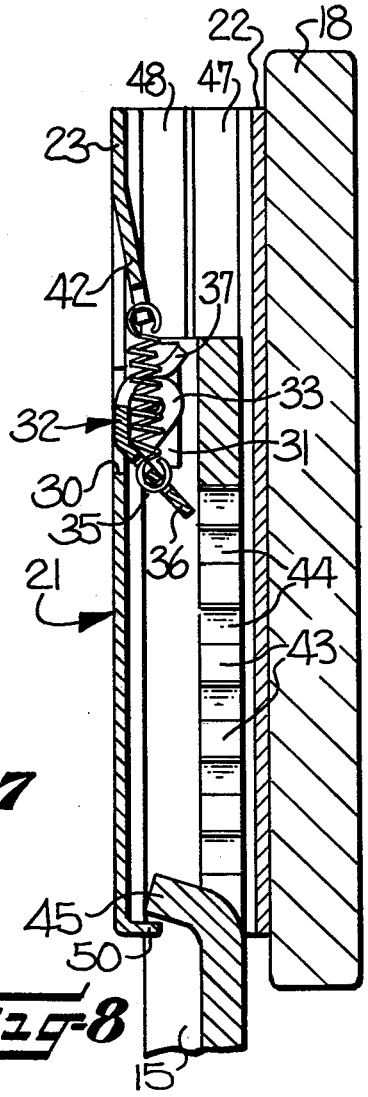

As the backrest 18 is lowered to the lowermost position, the tongue 36 of the pawl 32 engages the cam member 45, causing the pawl 32 to move in a counterclockwise direction so that the longitudinal axis and the line of action of the spring 40 then moves forwardly of the pivot point 34, as shown in FIG. 6, to switch the pawl 32 to the operative position. The spring 40 resiliently urges the pawl 32 in a counterclockwise direction with the downwardly angled upper surfaces of the ratchet fingers 35 in position to engage and ride up the notches 44 when the backrest 18 is again raised. When the backrest 18 has been raised to the desired position, the lower ends of the ratchet fingers 35 will engage and be supported on the corresponding notches 44 and support the backrest 18 in the adjusted position.

Thus, the pawl 32 is resiliently maintained in the operative position, with the ratchet fingers 35 being resiliently urged against the notches 44, when the backrest 18 is being raised. Upon reaching the upper end of the slot 43, the pawl 32 is switched to the inoperative position with the ratchet fingers 35 out of engagement with the notches 44. With the longitudinal axis and the line of action of the spring 40 positioned rearwardly of the pivot point 34 of the pawl 32, the pawl 32 is resiliently maintained in the inoperative position and the backrest 18 and the housing 21 are then moved to the lowermost position to reset the pawl 32 in the operative position in preparation for making a subsequent vertical adjustment of the backrest 18.

When it is desired to adjust the backrest 18 upwardly from any given adjusted position, it is merely necessary to lift the backrest 18 to the desired position. If it is desired to lower the backrest 18 below a previously adjusted position, the backrest 18 is first raised to its uppermost limit, to switch the pawl 32 to the inoperative position. The backrest 18 is then moved to its lowermost position to reset the pawl 32 to the operative position. Then, the backrest 18 is raised to the desired position and maintained in the adjusted position. These up and down movements of the backrest 18 can be easily made by a person while in the normal seated position.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. In an office chair including a seat, a vertically extending support member having its lower end secured to said seat, and a backrest supported for vertical adjustment on the upper end portion of said support member, the combination therewith of improved means for adjusting the vertical position of said backrest on said support member, said backrest adjusting means comprising a. a housing fixed on said backrest and supporting said backrest for vertical sliding movement on the upper portion of said support member, b. notch means extending vertically along the upper portion of said support member and including upper and lower ends, c. a pawl pivotally supported on said housing and including ratchet finger means positioned below the pivot point of said pawl, said pawl being movable between an operative position with said ratchet finger means in engagement with said notch means, and an inoperative position with said ratchet finger means out of engagement with said notch means, d. an elongate tension spring with a longitudinal axis and including upper and lower ends, said lower end of said tension spring being connected to said pawl below the pivot point thereof and adjacent said ratchet finger means, said upper end of said tension spring being connected to said housing and above the pivot point of said pawl, and said longitudinal axis of said tension spring being positioned on one side of the pivot point of said pawl when in said operative position and being positioned on the other side of the pivot point of said pawl when in said inoperative position, and e. operator means associated with said upper and lower ends of said notch means for engagement with said pawl, said operator means at the lower end of said notch means being operable to move said pawl into said operative position and maintained in said operative position by said spring axis being positioned on one side of the pawl pivot point when said backrest and said pawl are moved to the lower end of said notch means so that said backrest may be moved to the desired level and maintained in such adjusted position by engagement of said ratchet finger means with said notch means, said operator means at the upper end of said notch means being operable to move said pawl into said inoperative position and maintained in said inoperative position by said spring axis being positioned on the other side of the pawl pivot point when said backrest and said pawl have been moved to the upper end of said notch means so that said backrest may be freely moved to said lower end of said notch means in preparation for making a subsequent vertical adjustment of said backrest.

2. An office chair according to claim 1 wherein said notch means includes a central vertical slot and vertically spaced notches along opposite sides of said vertical slot.

3. An office chair according to claim 2 wherein said ratchet finger means comprises a pair of ratchet fingers, and an operating tongue positioned between and extending outwardly beyond said pair of ratchet fingers, said tongue being positioned to extend into said slot and said ratchet fingers being positioned to engage said vertically spaced notches when said pawl is in said operative position.

4. An office chair according to claim 3 wherein said operator means at said lower end of said notches includes a cam member being engageable by said tongue when said housing is moved to the lower limit to switch said pawl to said operative position.

5. An office chair according to claim 4 wherein said operator means at said upper end of said notches includes a portion of said support members above said slot which is engageable by said tongue when said housing is moved to the upper limit to switch said pawl to said inoperative position.

6. An office chair according to claim 1 wherein said housing includes a front stamped housing plate extending behind said support member, a rear stamped housing plate extending in front of said support member, and means connecting said front and rear housing plates together along opposite side edges thereof, and including slide guide bars supported in said front and rear housing plates and in engagement with opposed side portions of said support member.

7. An office chair according to claim 6 wherein said support member includes a relatively flat central portion with forwardly bent opposite side edges to provide rigidity thereto.

8. In an office chair including a seat, a vertically extending support member having its lower end secured to said seat, and a backrest supported for vertical movement on the upper end portion of said support member, the combination therewith of improved means for adjusting the backrest vertically of said support member, said backrest adjusting means comprising a. a housing fixed on said backrest and supporting said backrest for vertical sliding movement on a medial portion of said support member, b. notch means extending vertically along a medial portion of said support member and including a vertical slot with spaced notches along opposite sides of said slot, c. a pawl pivotally supported on said housing and including a pair of ratchet fingers positioned below the pivot point and being engageable with said notches, said pawl being movable between an operative position with said ratchet fingers in engagement with said notches, and an inoperative position with said ratchet fingers out of engagement with said notches, d. an elongate tension spring attached at one end to said pawl and adjacent said ratchet fingers and at the other end to said housing and above the pivot point of said pawl, the longitudinal axis of said spring extending on one side of the pivot point of said pawl when said pawl is in said operative position to resiliently maintain said ratchet fingers in engagement with said notches, said spring extending on the opposite side of the pivot point of said pawl when said pawl is in said inoperative position to resiliently maintain said ratchet fingers out of engagement with said notches, and e. operator means at the upper and lower ends of said notches for engagement with said pawl, said operator means at said lower end of said notches being operable to move said pawl into said operative position and maintained in said operative position by said spring axis being positioned on one side of the pawl pivot point when said backrest and said pawl are moved to the lower end of said notches so that said backrest may be raised to the desired level and maintained in adjusted position by engagement of said ratchet fingers with said notches, said operator means at said upper end of said notch means being operable to move said pawl into said inoperative position and maintained in said inoperative position by said spring axis being positioned on the other side of the pawl pivot point when said backrest and said pawl have been moved to the upper end of said notches so that said backrest may be freely moved to its lowermost position in preparation for making a subsequent vertical adjustment of said backrest.

9. Vertical height adjustment means for adjusting the vertical position of a vertically adjustable member supported for vertical movement on the upper end portion of an upstanding support of a fixed base member, said vertical height adjustment means comprising a. a housing fixed on said vertically adjustable member, said housing surrounding and supported for vertical sliding movement on the upper portion of said upstanding support, b. notch means extending vertically along the upper portion of said upstanding support and including upper and lower ends, said notch means including a central vertical slot and vertically spaced notches along opposite sides of said vertical slot, c. a pawl pivotally supported on said housing and including ratchet finger means at one end thereof, said ratchet finger means including a pair of ratchet fingers, and an operating tongue positioned between and extending outwardly beyond said pair of ratchet fingers, said pawl being movable between an operative position with said pair of ratchet fingers in engagement with said vertically spaced notches, and an inoperative position with said pair of ratchet fingers out of engagement with said vertically spaced notches, d. over center spring means operatively associated with said pawl and being operative along a line of action to selectively maintain said ratchet finger means in said operative position with said ratchet finger means in resilient engagement with said notch means, or in said inoperative position with said ratchet finger means out of engagement with said notch means, the line of action of said over center spring means being positioned on one side of the pawl pivot point when in said operative position and being positioned on the other side of the pawl pivot point when in said inoperative position, and e. operator means associated with said upper and lower ends of said notch means for engagement with said pawl, said operator means at the lower end of said notch means being operable to move said pawl into said operative position when said vertically adjustable member and said pawl are moved to the lower end of said notch means so that said vertically adjustable member may be moved to the desired level and maintained in such adjusted position by engagement of said ratchet finger means with said notch means, said operator means at the upper end of said notch means being operable to move said pawl into said inoperative position when said vertically adjustable member and said pawl have been moved to the upper end of said notch means so that said vertically adjustable member may be freely moved to said upper end of said notch means in preparation for making a subsequent vertical adjustment of said vertically adjustable member.

10. Vertical height adjustment means according to claim 9 wherein said operator means at said lower end of said notches includes a cam member being engageable by said tongue when said housing is moved to the lower limit to switch said pawl to said operative position and to limit downward movement of said vertically adjustable member.

11. Vertical height adjustment means according to claim 10 including stop means carried by and extending inwardly from the lower portion of said housing and beneath said cam member, said stop means being engageable with said cam member to limit upward movement of said vertically adjustable member.

* * * * *